US006092504A

United States Patent [19]

Barnes et al.

[11] Patent Number: 6,092,504

[45] Date of Patent: Jul. 25, 2000

[54] DEVICE FOR CONTROLLING ENGINE SPEED USING DUAL GOVERNORS

[75] Inventors: Travis E. Barnes, Loveland, Colo.; Michael S. Lukich, Chillicothe; Scott E. Nicholson, Metamora, both of Ill.

[73] Assignee: Caterpillar Inc., Peoria, Ill.

[21] Appl. No.: 09/129,064

[22] Filed: Aug. 4, 1998

[51] Int. Cl.[7] ..... F02D 31/00

[52] U.S. Cl. ..... 123/357; 123/358

[58] Field of Search ..... 123/357, 358, 123/352, 361

[56] References Cited

U.S. PATENT DOCUMENTS

| | | | |
|---|---|---|---|
| 3,886,915 | 6/1975 | Taplin | 123/357 |
| 4,219,000 | 8/1980 | Locher et al. | 123/357 |
| 4,245,599 | 1/1981 | Des Lauries | 123/361 |
| 4,354,467 | 10/1982 | Noddings et al. | 123/352 |
| 4,493,303 | 1/1985 | Thompson et al. | 123/352 |
| 4,597,368 | 7/1986 | Ament | 123/357 |
| 4,836,166 | 6/1989 | Wietelmann | 123/358 |
| 5,323,746 | 6/1994 | Best et al. | 123/357 |
| 5,339,781 | 8/1994 | Osawa | 123/357 |
| 5,357,912 | 10/1994 | Barnes et al. | 123/357 |
| 5,553,589 | 9/1996 | Middleton et al. | 123/352 |
| 5,586,538 | 12/1996 | Barnes | 123/446 |
| 5,915,356 | 6/1999 | Oishi et al. | 123/357 |

*Primary Examiner*—Thomas N. Moulis
*Attorney, Agent, or Firm*—Mary Jo Bertani

[57] ABSTRACT

The present invention is an apparatus for controlling the fuel rate to an engine using the throttle position, and for controlling the speed of the engine using decision logic to choose the best alternative among candidate fuel levels. A minimum speed governor determines a minimum fuel level at a predetermined low idle engine speed, a maximum speed governor determines a maximum fuel level at a predetermined high idle engine speed, and at least one fuel rate map is used to determine fuel level based on various engine operating parameters. Each governor outputs a fuel quantity signal based on the difference between the corresponding desired engine speed and the actual engine speed. The fuel rate map may be a multi-dimensional data table that provides fuel quantity signals to optimize engine performance based on the throttle position, engine speed, boost pressure, and other engine operating states. The fuel quantity signals from the lookup tables and the maximum speed governor are compared and the minimum value is chosen. The minimum value is then compared to the fuel quantity signal from the minimum speed governor, and the maximum value between these signals is provided as the output signal from the speed governor portion of the engine's electronic control module.

20 Claims, 3 Drawing Sheets

Fig. 3.

| DESIRED FUEL FLOW ($mm^3$) | | | | | | | | | | |
|---|---|---|---|---|---|---|---|---|---|---|
| ENGINE SPEED (RPM) | THROTTLE (%) | | | | | | | | | |
| | 10 | 20 | 30 | 40 | 50 | 60 | 70 | 80 | 90 | 100 |
| ENGINE SPEED 1 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |
| ENGINE SPEED 2 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |
| ENGINE SPEED 3 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |
| ENGINE SPEED 4 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |
| ENGINE SPEED 5 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |
| ENGINE SPEED 6 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |
| ENGINE SPEED 7 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |
| ENGINE SPEED 8 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |
| ENGINE SPEED 9 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |
| ENGINE SPEED 10 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |
| ENGINE SPEED 11 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |
| ENGINE SPEED 12 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |
| ENGINE SPEED 13 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |
| ENGINE SPEED 14 | FUEL FLOW | FUEL FLOW | FUEL FLOW | FUEL FLOW | FUEL FLOW | FUEL FLOW | FUEL FLOW | FUEL FLOW | FUEL FLOW | FUEL FLOW |

85

DEVICE FOR CONTROLLING ENGINE SPEED USING DUAL GOVERNORS

TECHNICAL FIELD

The present invention relates generally to an engine speed governor and, more particularly, to the use of two speed governors and engine maps for controlling the amount of fuel delivered to the engine.

BACKGROUND

An internal combustion engine may operate in a variety of different modes, particularly in modern engine systems, which are electronically controlled, based upon a variety of monitored engine operating parameters. Some typical operating modes include a cold mode, a warm mode, a cranking mode, a low idle mode, a high idle mode, and an in-between mode which is between the low idle mode and the high idle mode. Various engine operating parameters may be monitored to determine the engine operating mode including engine speed, throttle position, vehicle speed, coolant temperature, and oil temperature, as well as others. In each operating mode it is not uncommon to use different techniques to determine the amount of fuel to deliver to the engine for a fuel delivery cycle. For example, different fuel rate maps might be utilized in two different modes or a fuel rate map might be used in one mode and in another mode an engine speed governor with closed loop control may be used. Electronic control modules that regulate the quantity of fuel that the fuel injector dispenses often include software in the form of maps or multi-dimensional data tables that are used to define optimum fuel system operational parameters. One of these maps is a torque map which uses the actual engine speed signal to produce the maximum allowable fuel quantity signal based on the horsepower and torque characteristics of the engine. Another map is the emissions, or smoke limiter map, which limits the amount of smoke produced by the engine as a function of air manifold pressure or boost pressure, ambient temperature and pressure, and engine speed. The maximum allowable fuel quantity signal produced by the smoke map limits the quantity of fuel based on the quantity of air available to prevent excess smoke.

In many industrial diesel engine applications, the throttle setting indicates the speed at which an operator wants to run the engine, and fuel quantity is varied to maintain the desired engine speed. In contrast, the operator of an otto-cycle engine, such as an automobile engine, typically uses the throttle setting to control fuel quantity, and thereby the speed, of the vehicle being driven by the engine. Currently, many diesel systems use a single full range speed governor whereby the throttle position determines desired engine speed across the operating regime of the engine. This is acceptable for heavy vehicles such as trucks, but is not acceptable for use in automobiles where the throttle, or gas pedal, is used to control fuel quantity to attain the desired vehicle speed. In order to adapt an engine control system originally designed for constant speed engines for use with automobiles, means are required to convert the throttle from a desired engine speed indicator to a desired fuel quantity, or vehicle speed, indicator.

Accordingly, the present invention is directed to overcoming one or more of the problems as set forth above.

DISCLOSURE OF THE INVENTION

The present invention is an apparatus for controlling the fuel rate to an engine using the throttle position, and for controlling the speed of the engine using decision logic to choose the best alternative among candidate fuel levels. A minimum speed governor determines a minimum fuel level at a predetermined low idle engine speed, a maximum speed governor determines a maximum fuel level at a predetermined high idle engine speed, and at least one fuel rate map is used to determine fuel level based on various engine operating parameters. Each governor outputs a fuel quantity signal based on the difference between the corresponding desired engine speed and the actual engine speed. The fuel rate map may be a multi-dimensional data table that provides fuel quantity signals to optimize engine performance based on the throttle position, engine speed, boost pressure, and other engine operating states. The fuel quantity signals from the lookup tables and the maximum speed governor are compared and the minimum value is chosen. The minimum value is then compared to the fuel quantity signal from the minimum speed governor, and the maximum value between these signals is provided as the output signal from the speed governor portion of the engine's electronic control module.

BRIEF DESCRIPTION OF DRAWINGS

FIG. 3 is a data table representing a torque map.

BEST MODE FOR CARRYING OUT THE INVENTION

Figure 1:
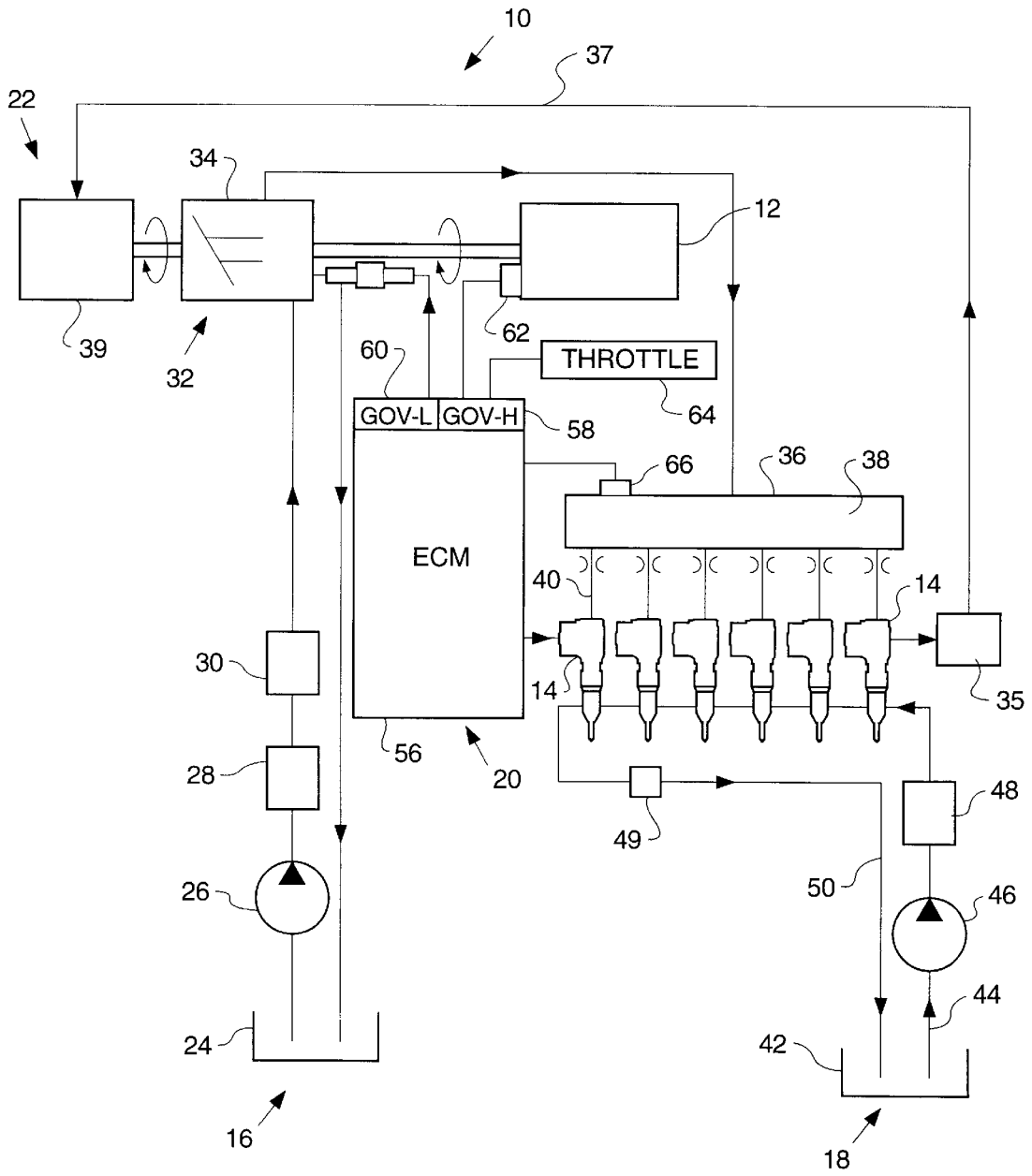
FIG. 1 is a diagrammatic general schematic view of a hydraulically actuated electronically controlled injector fuel system for an engine having a plurality of fuel injectors.

Throughout the specification and figures, like reference numerals refer to like components or parts. Referring to FIG. 1, there is shown a hydraulically actuated electronically controlled fuel injector system (hereinafter referred to as HEUI fuel system). Typical of such systems are those shown and described in U.S. Pat. No. 5,463,996, U.S. Pat. No. 5,669,355, U.S. Pat. No. 5,673,669, U.S. Pat. No. 5,687,693, and U.S. Pat. No. 5,697,342. The exemplary HEUI fuel system is shown in FIG. 1 as adapted for a direct-injection diesel-cycle internal combustion engine 12.

HEUI fuel system 10 includes one or more hydraulically actuated electronically controlled injectors 14, such as unit fuel injectors, each adapted to be positioned in a respective cylinder head bore of engine 12. The system 10 further includes apparatus or means 16 for supplying hydraulic actuating fluid to each injector 14, apparatus or means 18 for supplying fuel to each injector, apparatus or means 20 for electronically controlling the manner in which fuel is injected by injectors 14, including timing, number of injections, and injection profile, and actuating fluid pressure of the HEUI fuel system 10 independent of engine speed and load. Apparatus or means 22 for re-circulating or recovering hydraulic energy of the hydraulic actuating fluid supplied to injectors 14 is also provided.

Hydraulic actuating fluid supply means 16 preferably includes an actuating fluid sump 24, a relatively low pressure actuating fluid transfer pump 26, an actuating fluid cooler 28, one or more actuating fluid filters 30, a source or means 32 for generating relatively high pressure actuating fluid, such as a relatively high pressure actuating fluid pump 34, and at least one relatively high pressure fluid manifold 36. The actuating fluid is preferably engine lubricating oil. Alternatively, the actuating fluid could be fuel. Apparatus 22 may include a waste actuating fluid control valve 35 for each injector, a common re-circulation line 37, and a hydraulic motor 39 connected between the actuating fluid pump 34 and re-circulation line 37.

Actuating fluid manifold 36, associated with injectors 14, includes a common injection actuating pressure 38 and a plurality of rail branch passages 40 extending from common rail 38 and arranged in fluid communication between common rail 38 and actuating fluid inlets of respective injectors 14. Common injection actuation pressure 38 is also arranged in fluid communication with the outlet from high pressure actuating fluid pump 34.

Fuel supplying means 18 includes a fuel tank 42, a fuel supply passage 44 arranged in fluid communication between fuel tank 42 and a fuel inlet of each injector 14, a relatively low pressure fuel transfer pump 46, one or more fuel filters 48, a fuel supply regulating valve 49, and a fuel circulation and return passage 50 arranged in fluid communication between injectors 14 and fuel tank 42. The various fuel passages may be provided in a manner commonly known in the art.

Electronic controlling means 20 preferably includes an electronic control module (ECM) 56, the use of which is well known in the art. The ECM 56 included in the present invention includes processing means such as a microcontroller or microprocessor, two engine speed governors 58, 60 (GOV-H and GOV-L) such as proportional-integral-differential (PID) controllers that regulate fuel quantity during low speed and high speed idle as discussed hereinbelow, and circuitry including input/output circuitry and the like. The ECM 56 also uses engine maps to regulate the amount of fuel injected in the engine. The term map, as used herein, refers to a multi-dimensional data table from which data may be extracted using a software-implemented table look-up routine, as is well known in the art. Such engine maps may include torque maps, smoke maps, or any other type of map that may be used to control fuel injection timing, fuel quantity injected, fuel injection pressure, number of separate injections per injection cycle, time intervals between injection segments, and fuel quantity injected by each injection segment. Each of such parameters are variably controllable independent of engine speed and load.

Associated with a camshaft of engine 12 is an engine speed sensor 62 which produces speed indicative signals. Engine speed sensor 62 is connected to the governors 58, 60 of ECM 56 for monitoring the engine speed and piston position for timing purposes. A throttle 64 is also provided and produces signals indicative of a desired engine speed, or alternatively, fuel quantity to the engine, throttle 64 also being connected to the governors 58, 60 of ECM 56. An actuating fluid pressure sensor 66 for sensing the pressure within common rail 38 and producing pressure indicative signals is also connected to ECM 56.

Each of the injectors 14 is preferably of a type such as that shown and described in one of U.S. Pat. No. 5,463,996, U.S. Pat. No. 5,669,355, U.S. Pat. No. 5,673,669, U.S. Pat. No. 5,687,693, and U.S. Pat. No. 5,697,342. However, it is recognized that the present invention could be utilized in association with other variations of hydraulically actuated electronically controlled injectors.

Figure 2:
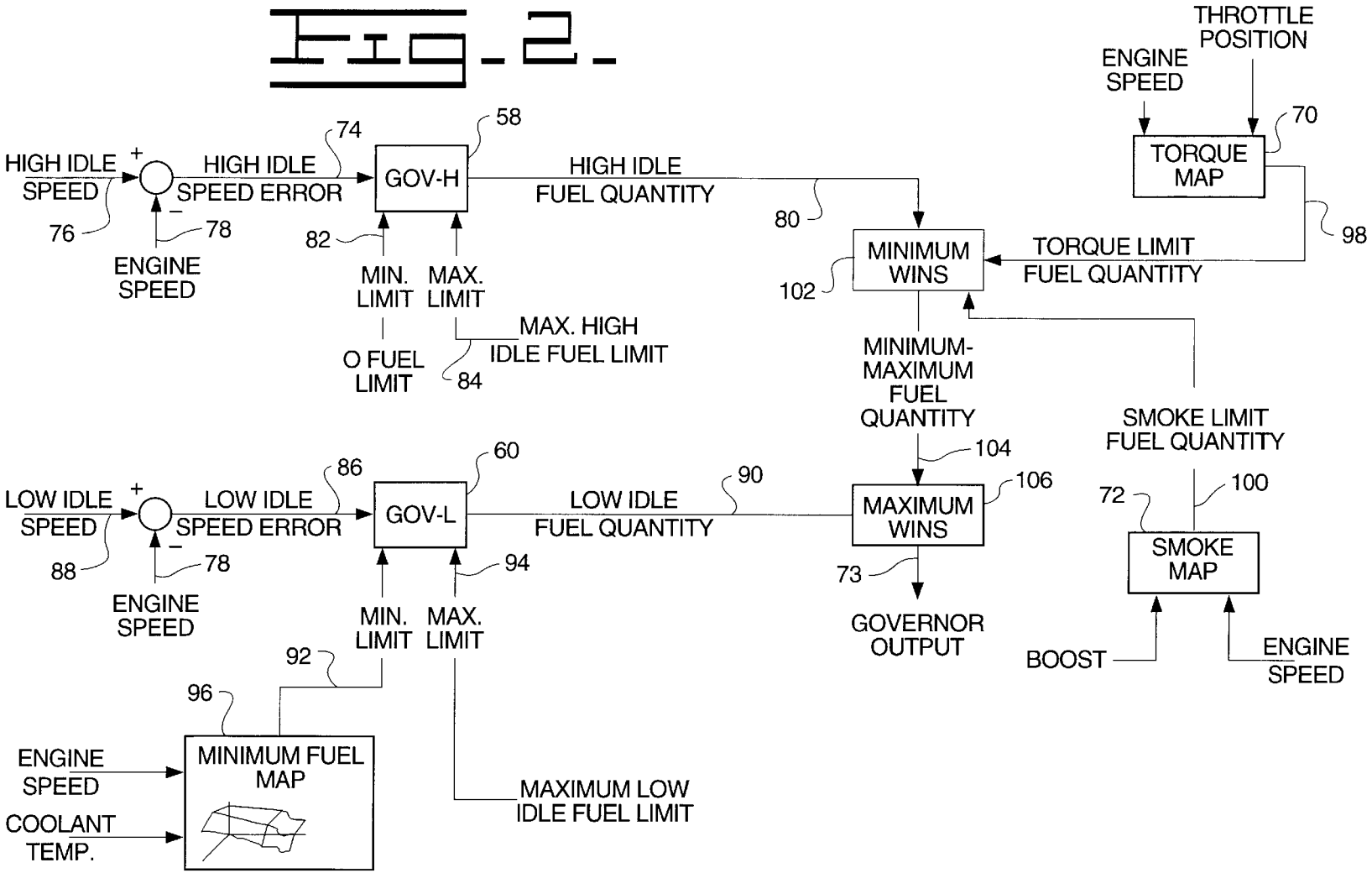
FIG. 2 is a block diagram view of the present invention for controlling fuel quantity to an engine using a maximum speed governor and a minimum speed governor.

FIG. 2 shows a functional block diagram of the present invention for controlling the speed of an engine using the maximum speed governor 58, the minimum speed governor 60, and one or more engine maps, such as a torque map 70 and a smoke map 72. The calculations and logic associated with the minimum-maximum speed governor configuration of the present invention may be implemented in data processing means such as software executed in a microprocessor-based computer, as is well known to those skilled in the art. The maximum speed governor 58 protects the engine from over-speeding when a load is removed. The minimum speed governor 60 prevents the engine from stopping when loads are applied while the engine is running at low speed. The fuel quantities derived from the engine maps 70, 72 are used at speeds between the low and high idle speeds, and are based on engine performance parameters. Fuel quantity signals from the maximum speed governor 58, the minimum speed governor 60, and the engine maps 70, 72, are calculated for each engine fuel injection cycle. Only one of the signals is output to the engine to represent the speed governor output signal 73, however, the present invention includes means for selecting which fuel quantity signal to use as the speed governor output signal 73 as described hereinbelow.

A high idle speed error signal 74 based on the difference between the desired high idle speed 76 and the actual engine speed 78 is calculated for input to the maximum speed governor 58. The maximum speed governor 58 includes means for determining a high idle fuel quantity signal 80 to output to the engine control module 56 based on the high idle speed error signal 74, such means including a proportional-integral (PI) control law, as is well-known in the art. Note that although a PI control is discussed, it will be apparent to those skilled in the art that other closed loop governors may be utilized.

The high idle fuel quantity signal 80 is limited to a value less than or equal to a minimum fuel quantity limit 82, such as zero, and a maximum fuel quantity limit 84, which may be a constant value or a variable value based on a function or operating condition. The initial maximum fuel quantity limit 84 may, for example, be determined using a torque map, such as the torque map 85 shown in FIG. 3. Torque map 85 is dependent on engine parameters such as engine speed and throttle position. Preferably, the maximum high idle fuel limit should initially be set to 90 cubic millimeters. The minimum high idle fuel limit is preferably set to zero to allow the maximum speed governor to shut the engine down by setting fuel quantity to zero in the event that an engine overspeed condition exists.

A low idle speed error signal 86 based on the difference between a desired low idle speed 88 and the actual engine speed 78 is calculated for input to the minimum speed governor 60. The minimum speed governor 60 includes means for determining a low idle fuel quantity signal 90 to output to the engine control module 56 based on the low idle speed error signal 86, such means including a proportional-integral control law, as is well-known in the art.

The low idle fuel quantity signal 90 is limited between a minimum low idle fuel limit 92 and a maximum low idle fuel limit 94. The minimum low idle fuel limit 92 is obtained from a fuel limit map 96, which is a function of engine operating parameters such as engine speed and coolant temperature. The maximum low idle fuel limit 94 may be a constant value or a variable value based on a function of one or more operating conditions. In a preferred embodiment, the maximum low idle fuel limit 94 is set to a predetermined constant of approximately 35 cubic millimeters, however, this value depends on the particular engine being used. The low idle fuel quantity signal 90 represents the minimum fuel quantity needed to accelerate or decelerate the engine speed to drive the low idle speed error signal 86 toward zero.

Along with determining the high idle fuel quantity signal 80 using the maximum speed governor 58 and the low idle fuel quantity signal 90 using the minimum speed governor 60, the present invention also determines fuel quantity signals from one or more maps, such as the torque map 70 and the smoke map 72. An example of a torque map 70 is shown in FIG. 3, where the fuel quantity is a function of engine speed and throttle position. The torque map 70 contains a plurality of throttle position curves, each curve having a plurality of values that correspond to an actual engine speed and desired fuel quantity. Based on the magnitude of the throttle position signal and the actual engine speed signal, a desired fuel quantity is selected and a respective torque limit fuel quantity signal 98 is produced. Another desired fuel quantity signal may be generated using an emissions limiter or smoke map 72 that is used to limit the amount of smoke produced by the engine. The smoke map 72 is a function of several possible inputs including: an air inlet pressure signal indicative of, for example, air manifold pressure or boost pressure, an ambient pressure signal, an ambient temperature signal, and/or an engine speed signal. The smoke limit fuel quantity signal 100 limits the quantity of fuel based on the quantity of air available to prevent excess smoke. Note that although two maps 70, 72 are shown, it may be apparent to those skilled in the art that other such maps may be employed.

The high idle fuel quantity signal 80, the torque limit fuel quantity signal 98, and the smoke limit fuel quantity signal 100, are maximum allowable fuel quantity signals. It is likely that the values of these signals will be different from one another during any given cycle. In order to operate the engine within the lowest limit, minimum-wins comparing block 102 compares the signals 80, 98, 100, and outputs the signal having the minimum value. The minimum-maximum fuel quantity signal 104 is input to maximum-wins comparing block 106, wherein the low idle fuel quantity signal 90 is compared to the minimum-maximum fuel quantity signal 104, and the maximum value between them is output as governor output signal 74.

The dual speed governor configuration of the present invention will advantageously provide smooth transition from low idle engine speed to higher engine speeds when the maximum low idle fuel limit 94 and the fuel limits corresponding to low throttle portions of the torque map 70 have similar values. These values are chosen according to the performance characteristics of the particular engine being used.

INDUSTRIAL APPLICABILITY

Using two governors 58, 60 to set a minimum and maximum fuel level, as opposed to using one full range governor, provides for better engine responsiveness and therefore, better driving characteristics. The minimum speed governor 60 allows better lugging characteristics and more consistent idle speed as loads change compared to systems that control fuel rate only. In addition, the maximum speed governor 58 protects the engine from over-speeding in the event that a load is suddenly removed.

With, the present invention, the engine control system can be simplified over prior art systems because predetermined values for high idle speed 76 and low idle speed 88 replace desired engine speed calculations. It should also be noted that the maximum speed governor 58 may be removed if the fuel flow limit from the torque map 70, or any other map used with the present invention, goes to zero at the desired high speeds. A value of zero for the fuel flow limit will cut off fuel to the engine and prevent the engine from overspeeding, which is the function of the maximum speed governor 58. If the fuel quantity limits in the torque map, or any of the other maps, do not go to zero at the desired high speed, however, the maximum speed governor 58 should be included with the present invention.

Other aspects, objects and advantages of the present invention can be obtained from a study of the drawings, the disclosure and the appended claims.

What is claimed is:

1. An apparatus for controlling the minimum and maximum speed of an engine, the apparatus comprising:

a minimum speed governor;

a maximum speed governor;

data processing means operable to provide a low idle speed error signal to the minimum speed governor, the low idle speed error signal being based on the difference between a desired low idle speed and engine speed;

the data processing means being further operable to provide a high idle speed error signal to the maximum speed governor, the high idle speed error signal being based on the difference between a desired high idle speed and engine speed;

the minimum speed governor being operable to provide a low idle fuel quantity signal; and the maximum speed governor being operable to provide a high idle fuel quantity signal.

2. The apparatus, as set forth in claim 1, wherein the low idle fuel quantity signal is limited to a value greater than or equal to a first minimum limit, the first minimum limit being based on a minimum fuel map that is dependent on engine operating parameters.

3. The apparatus, as set forth in claim 1, wherein the low idle fuel quantity signal is limited to a value less than or equal to a first maximum limit, the first maximum limit being a first predetermined constant.

4. The apparatus, as set forth in claim 1, wherein the high idle fuel quantity signal is limited to a value greater than or equal to a second minimum fuel quantity limit and less than or equal to a second maximum fuel quantity limit.

5. The apparatus, as set forth in claim 4, wherein the second minimum limit is zero and the second maximum limit is a second predetermined constant.

6. The apparatus, as set forth in claim 1, further comprising:

data processing means operable to output a minimum signal that is the minimum value between a fuel quantity signal from at least one engine map and the high idle fuel quantity signal;

the data processing means being further operable to output a governor output signal that is the maximum value between the minimum signal and the low idle fuel quantity signal.

7. The apparatus, as set forth in claim 6, wherein the at least one engine map is a torque map that is a function of engine speed and position of the throttle.

8. The apparatus, as set forth in claim 6, wherein the at least one engine map is a smoke map that is a function of engine speed, ambient air temperature and pressure, and air manifold pressure.

9. An apparatus for controlling the minimum and maximum speed of an engine, the apparatus comprising:

a minimum speed governor operable to output a low idle fuel quantity signal based on a desired low idle speed signal;

a maximum speed governor operable to output a high idle fuel quantity signal based on a desired high idle speed signal; and means for selecting between the high idle fuel quantity signal and the low idle fuel quantity signal to provide a governor output fuel quantity signal to the engine.

10. The apparatus, as set forth in claim 9, further including means for limiting the low idle fuel quantity signal between a first minimum fuel quantity limit and a first maximum fuel quantity limit; and means for limiting the high idle fuel quantity signal between a second minimum fuel quantity limit and a second maximum fuel quantity limit.

11. The apparatus, as set forth in claim 10, wherein the first minimum limit is based on a minimum fuel map that is dependent on engine speed and coolant temperature.

12. The apparatus, as set forth in claim 10, wherein the first maximum limit is a first predetermined constant.

13. The apparatus, as set forth in claim 10, wherein the second minimum limit is zero.

14. The apparatus, as set forth in claim 10, wherein the second maximum limit is a second predetermined constant.

15. The apparatus, as set forth in claim 9, wherein the means for selecting between the high idle fuel quantity signal and the low idle fuel quantity signal comprises:

data processing means operable to output a minimum-maximum fuel quantity signal that is the minimum value between a signal from a torque map, a signal from a smoke map, and the high idle fuel quantity signal;

the data processing means being further operable to output a governor output signal that is the maximum value between the minimum signal and the low idle fuel quantity signal.

16. The apparatus, as set forth in claim 15, wherein the torque map is dependent on engine speed and the position of the throttle.

17. The apparatus, as set forth in claim 15, wherein the smoke map is dependent on engine speed, ambient air temperature and pressure, and air manifold pressure.

18. An apparatus for controlling the idle speed of a diesel engine, the apparatus comprising:

an electronic control module operable to compute a high idle speed error signal based on engine speed and a desired high idle speed, the electronic control module being further operable to input the high idle speed error signal to a maximum speed governor, wherein the maximum speed governor includes a control law operable to generate a high idle fuel quantity signal based on the high idle speed error signal;

the electronic control module being further operable to compute a low idle speed error signal based on engine speed and a desired low idle speed, the electronic control module being further operable to input the low idle speed error signal to a minimum speed governor, wherein the minimum speed governor includes a control law operable to generate a low idle fuel quantity signal based on the low idle speed error signal; and means for selecting between the high idle fuel quantity signal and the low idle fuel quantity signal to provide a governor output fuel quantity signal to the engine.

19. The apparatus, as set forth in claim 18, wherein the minimum speed governor is further operable to limit the low idle fuel quantity signal between a first minimum fuel quantity limit and a first maximum fuel quantity limit; and the maximum speed governor is further operable to limit the high idle fuel quantity signal between a second minimum fuel quantity limit and a second maximum fuel quantity limit.

20. The apparatus, as set forth in claim 18, wherein the means for selecting between the high idle fuel quantity signal and the low idle fuel quantity signal comprises:

data processing means operable to output a minimum-maximum fuel quantity signal that is the minimum value between a fuel quantity signal from a torque map, a fuel quantity signal from a smoke map, and the high idle fuel quantity signal;

the data processing means being further operable to output the governor output fuel quantity signal that is the maximum value between the minimum-maximum fuel quantity signal and the low idle fuel quantity signal.

* * * * *